US010427206B1

(12) United States Patent
Camilo

(10) Patent No.: US 10,427,206 B1
(45) Date of Patent: Oct. 1, 2019

(54) STAMPING GROOVE FOR TARGET WHEEL

(71) Applicant: Schaeffler Technologies AG & Co. KG, Herzogenaurach (DE)

(72) Inventor: Alexandre Camilo, Rochester Hills, MI (US)

(73) Assignee: SHAEFFLER TECHNOLOGIES AG & CO. KG, Herzogenaurach (DE)

( * ) Notice: Subject to any disclaimer, the term of this patent is extended or adjusted under 35 U.S.C. 154(b) by 0 days.

(21) Appl. No.: 16/023,955

(22) Filed: Jun. 29, 2018

(51) Int. Cl.
*F01L 1/34* (2006.01)
*B21D 53/84* (2006.01)
*F01L 1/344* (2006.01)

(52) U.S. Cl.
CPC ..... *B21D 53/845* (2013.01); *F01L 1/3442* (2013.01); *F01L 2103/00* (2013.01); *F01L 2820/041* (2013.01)

(58) Field of Classification Search
CPC .. B21D 53/845; F01L 1/3442; F01L 2103/00; F01L 2820/041
USPC ..... 123/90.15, 90.17
See application file for complete search history.

(56) References Cited

U.S. PATENT DOCUMENTS 6,609,498 B2 8/2003 Mathews et al.
7,305,949 B2 12/2007 McCarthy et al.
7,614,370 B2 * 11/2009 Fischer ..... F01L 1/022 123/90.15
8,171,902 B2 5/2012 Weber

* cited by examiner

*Primary Examiner* — Ching Chang
(74) *Attorney, Agent, or Firm* — Volpe and Koenig, P.C.

(57) ABSTRACT

A method of forming a target wheel for a camshaft phaser assembly is disclosed. The method includes providing a sheet metal body, and stamping the sheet metal body to form a sensor tab. The sensor tab includes a medial flange positioned between first and second axially extending edges. The sensor tab includes: at least one inner corner defined between the medial flange and at least one of the first axially extending edge or the second axially extending edge, and at least one outer corner defined between the medial flange and at least one of the first axially extending edge or the second axially extending edge. The method includes forming a groove in the at least one inner corner.

14 Claims, 7 Drawing Sheets

STAMPING GROOVE FOR TARGET WHEEL

FIELD OF INVENTION

The present invention relates to a target wheel for a camshaft phaser assembly.

BACKGROUND

Camshaft phaser assemblies are well known in the automotive field. It is also known to include a target wheel in camshaft phaser assemblies to determine an angular position of a phaser rotor. Known camshaft phaser assemblies including target wheels are disclosed in U.S. Pat. Nos. 7,305,949 and 6,609,498.

Target wheels are often formed from bent sheet metal to reduce pressing forces and maintain a relatively low rotating inertia. Sensor tabs can be formed around an outer periphery of the target wheel. A position sensor is arranged adjacent to the sensor tab to detect an angular position of a phaser rotor. Due to handling during installation, these types of targets wheels can undergo deformation. These target wheels may also include relatively brittle or weak tabs, or undergo installation issues. Any one of these issues can result in timing problems for the target wheel, and impact the ability of an associated sensor to detect a position of the camshaft.

One type of known sensor tab for target wheels includes rolled edges. However, these known types of sensor tabs result in outer corners formed by the rolled edges that have a relatively large radius. The relatively large radius caused by these rolled edges causes a delayed reading of the position of the sensor tab.

It would be desirable to provide an improved profile for sensor tabs of a target wheel that avoids inaccurate or delayed reading of a relative position of the sensor tabs to a sensor.

SUMMARY

A method of forming a target wheel for a camshaft phaser assembly is disclosed. The method includes: (i) providing a sheet metal body, and (ii) stamping the sheet metal body to form at least one sensor tab along a radially outer edge of the sheet metal body. The at least one sensor tab includes a medial flange positioned between first and second axially extending edges. The at least one sensor tab includes: at least one inner corner defined between the medial flange and at least one of the first axially extending edge or the second axially extending edge, and at least one outer corner defined between the medial flange and at least one of the first axially extending edge or the second axially extending edge. The method includes (iii) forming a groove in the at least one inner corner.

In one embodiment, the at least one outer corner has a first radius prior to step (iii), and the at least one outer corner has a second radius that is less than the first radius after step (iii).

The groove formation results in material of the sheet metal body being forced from the inner corner to the outer corner, resulting in a smaller radius for the curvature defined by the outer corner between the medial flange and one of the axially extending edges.

In one embodiment, a target wheel for a camshaft phaser assembly is disclosed. The target wheel includes a sheet metal body including at least one sensor tab formed along a radially outer edge of the sheet metal body. The at least one sensor tab includes a medial flange positioned between first and second axially extending edges. The at least one sensor tab includes at least one inner corner defined between the medial flange and at least one of the first axially extending edge or the second axially extending edge. At least one outer corner is defined between the medial flange and at least one of the first axially extending edge or the second axially extending edge. A groove is formed in the at least one inner corner.

In one embodiment, the groove provides a localized reduced thickness of the sheet metal body at the at least one inner corner relative to areas of the sheet metal body away from the at least one inner corner.

BRIEF DESCRIPTION OF THE DRAWINGS

The foregoing Summary and the following detailed description will be better understood when read in conjunction with the appended drawings, which illustrate a preferred embodiment of the invention. In the drawings.

DETAILED DESCRIPTION OF THE PREFERRED EMBODIMENTS

Figure 1:
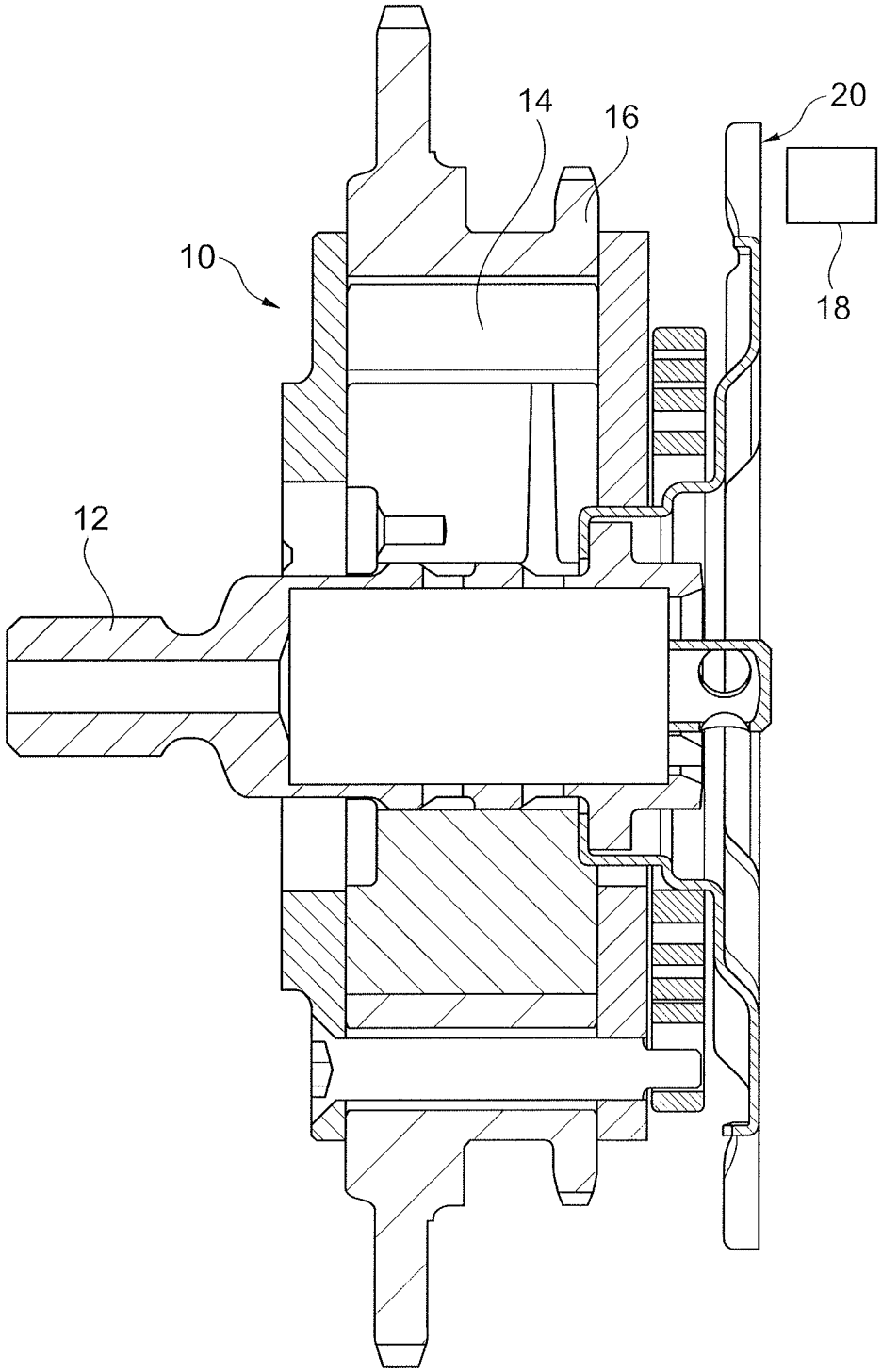
FIG. 1 is cross-sectional view of a camshaft phaser assembly including a target wheel.
Figure 2:
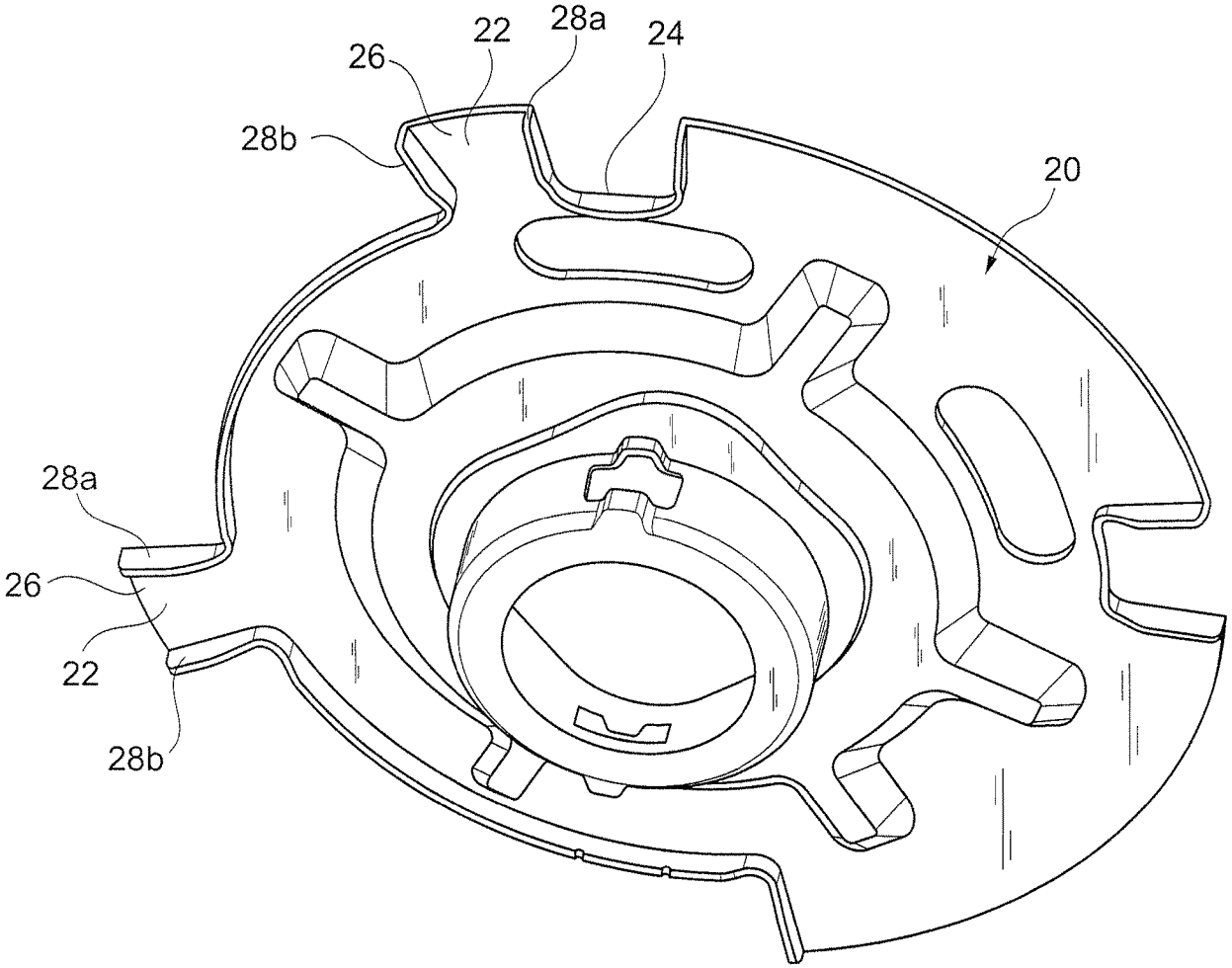
FIG. 2 is a perspective view of the target wheel of FIG. 1.
Figure 3A:
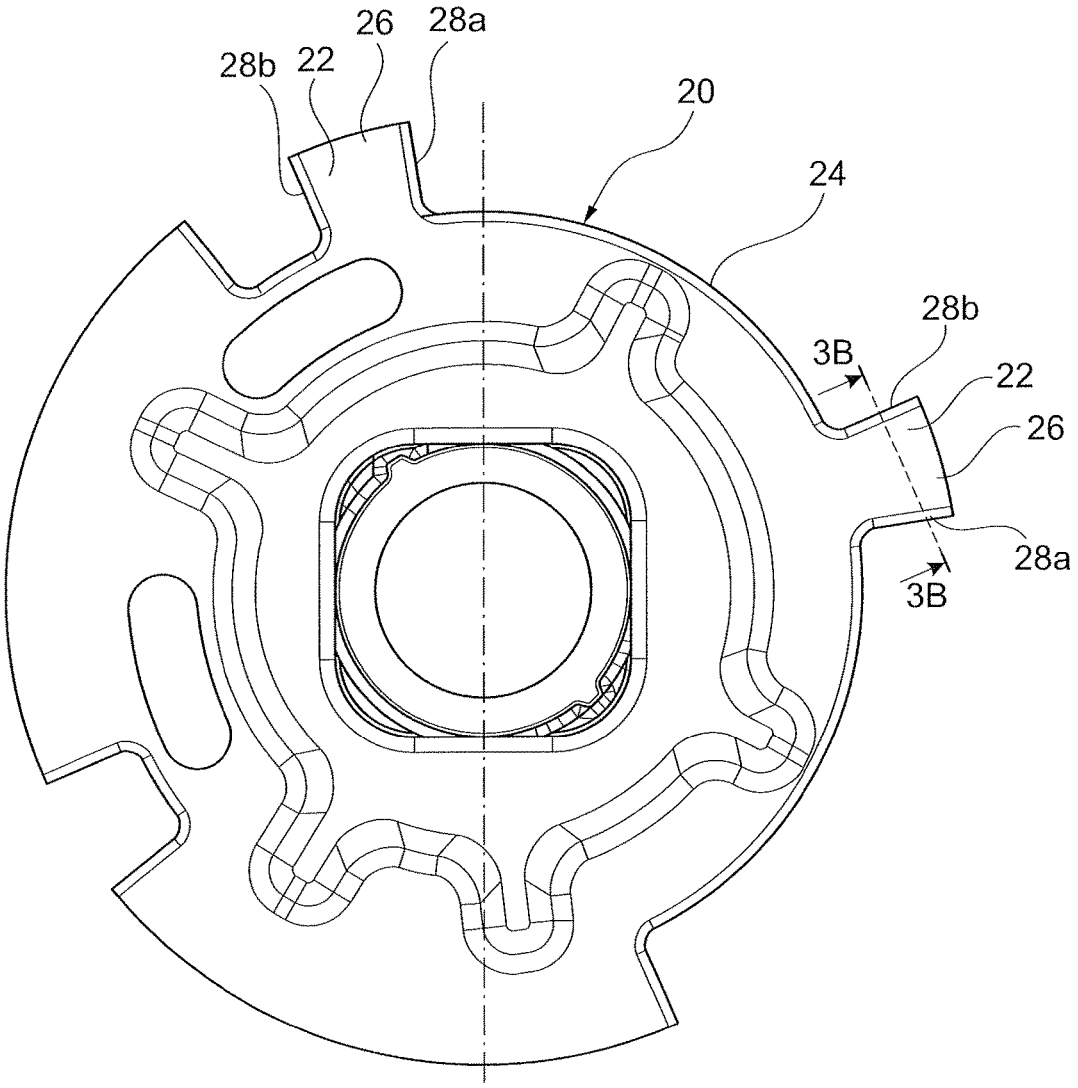
FIG. 3A is a planar view of the target wheel of FIGS. 1 and 2.
Figure 3B:
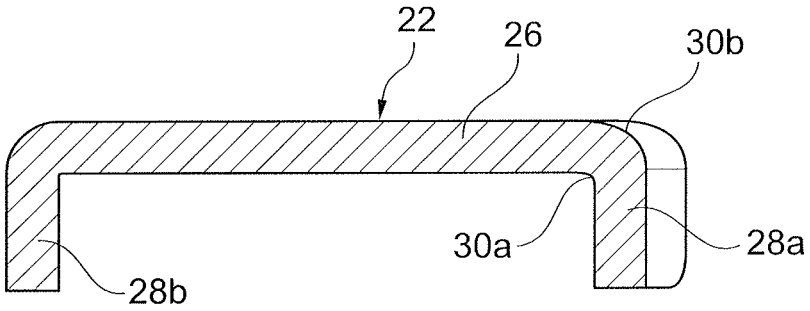
FIG. 3B is a cross-sectional view of the target wheel along line 3B-3B of FIG. 3A.

Certain terminology is used in the following description for convenience only and is not limiting. The words "front," "rear," "upper" and "lower" designate directions in the drawings to which reference is made. The words "inwardly" and "outwardly" refer to directions toward and away from the parts referenced in the drawings. "Axially" refers to a direction along the axis of a shaft. A reference to a list of items that are cited as "at least one of a, b, or c" (where a, b, and c represent the items being listed) means any single one of the items a, b, or c, or combinations thereof. The terminology includes the words specifically noted above, derivatives thereof and words of similar import.

Referring to FIG. 1, a camshaft phaser assembly 10 is disclosed. The camshaft phaser assembly 10 includes a rotor 14, a stator 16, and a central valve 12 that is arranged within a target wheel 20. The target wheel 20 is connected to the rotor 14, which is connected to the stator 16. Although only certain features are identified in the camshaft phaser assembly 10 in FIG. 1, one of ordinary skill in the art would understand that additional features can be included in the camshaft phaser assembly 10.

In one embodiment, a sensor 18 is positioned adjacent to the target wheel 20. In one embodiment, the sensor 18 is positioned axially adjacent to the target wheel 20. The sensor 18 determines a position of the target wheel 20 based on positions of tabs formed on the target wheel 20. The sensor 18 can include any type of known sensor configuration, including an associated micro-processor based controller, CPU, data, and other electronic components.

The target wheel 20 includes a plurality of sensor tabs 22 along a radially outer edge 24 of the target wheel 20. Each of the sensor tabs 22 includes rolled edges with a medial flange 26 positioned between first and second axially extending edges 28*a*, 28*b*. These first and second axially extending edges 28*a*, 28*b* are also known as falling and rising edges. The sensor tab 22 includes at least one inner corner 30*a* defined between the medial flange 26 and at least one of the first axially extending edge 28*a* or the second axially extending edge 28*b*. The sensor tab 22 includes at least one outer corner 30*b* defined between the medial flange 26 and at least one of the first axially extending edge 28*a* or the second axially edge 28*b*.

In one embodiment, a method of forming a target wheel 20 for a camshaft phaser assembly 10 is disclosed. The method includes providing a sheet metal body, and stamping the sheet metal body to form at least one sensor tab 22 along a radially outer edge 24 of the sheet metal body. In one embodiment, the at least one sensor tab 22 includes two sensor tabs 22.

Figure 4:
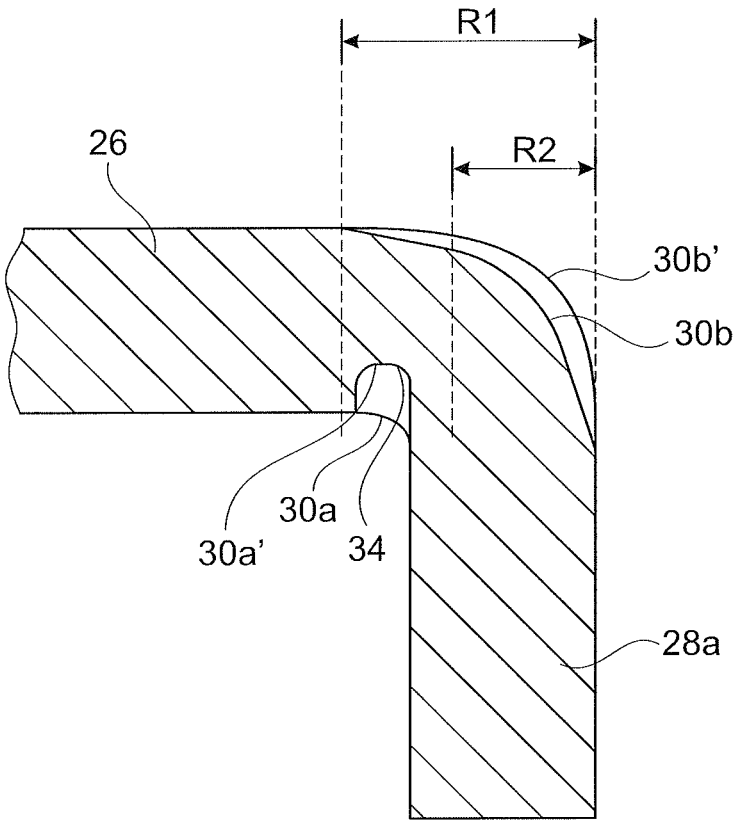
FIG. 4 is a magnified view a sensor tab of the target wheel.

As shown in FIGS. 2, 3A, 3B, and 4, the at least one sensor tab 22 includes a medial flange 26 positioned between first and second axially extending edges 28*a*, 28*b*. The at least one sensor tab 22 includes: at least one inner corner 30*a* defined between the medial flange 26 and at least one of the first axially extending edge 28*a* or the second axially extending edge 28*b*, and at least one outer corner 30*b* defined between the medial flange 26 and at least one of the first axially extending edge 28*a* or the second axially extending edge 28*b*. As shown in FIG. 4, the at least one outer corner 30*b* has a first radius (R1).

In one embodiment, the method includes forming a groove 34 in the at least one inner corner 30*a*' such that the at least one outer corner 30*b*' defines a second radius (R2) that is less than the first radius (R1). As shown in FIG. 4, a profile of the outer corner 30*b* is altered based on formation of the groove 34. The modified outer corner 30*b*' is formed as a result of material from the inner corner 30*a* being pushed outwardly to a secondary position 30*a*'.

In one embodiment, the groove 34 is formed via stamping. One of ordinary skill in the art would recognize that a variety of formation processes could be used to form the groove 34.

By pushing material from the inner corner 30*a* to the outer corner 30*b*', an associated sensor 18 can obtain a more reliable and accurate reading of the sensor tabs 22 due to a relatively thicker profile of the outer corner 30*b*'. This formation process avoids reading delays for the associated sensor 18 when detecting the sensor tab 22.

In one embodiment, the second radius (R2) is 40%-70% of the first radius (R1). In one embodiment, the first radius (R1) is 1.6 mm-2.0 mm. In one embodiment, the second radius (R2) is 0.8 mm-1.2 mm. One of ordinary skill in the art would understand that the radius of the outer corner 30*b*' can be varied depending on a specific application. The present disclosure is generally directed to reducing a radius of the outer corner 30*b*'.

In one embodiment, the groove 34 has a depth of 0.3 mm-0.6 mm. In one embodiment, the groove has a length of 0.1 mm-0.5 mm. One of ordinary skill in the art would understand that the depth of the groove 34 can be varied depending upon a specific application.

One of ordinary skill in the art would understand that the formation methods for making the target wheel 20 and the associated features of the sensor tab 22 can include known manufacturing processes, such as disclosed in U.S. Pat. No. 8,171,902, which is incorporated by reference as if fully set forth herein. In one embodiment, the target wheel 20 is formed via a deep-drawing method, including a deep-drawing stamp, mold, mandrel, holder, etc.

Figure 5:
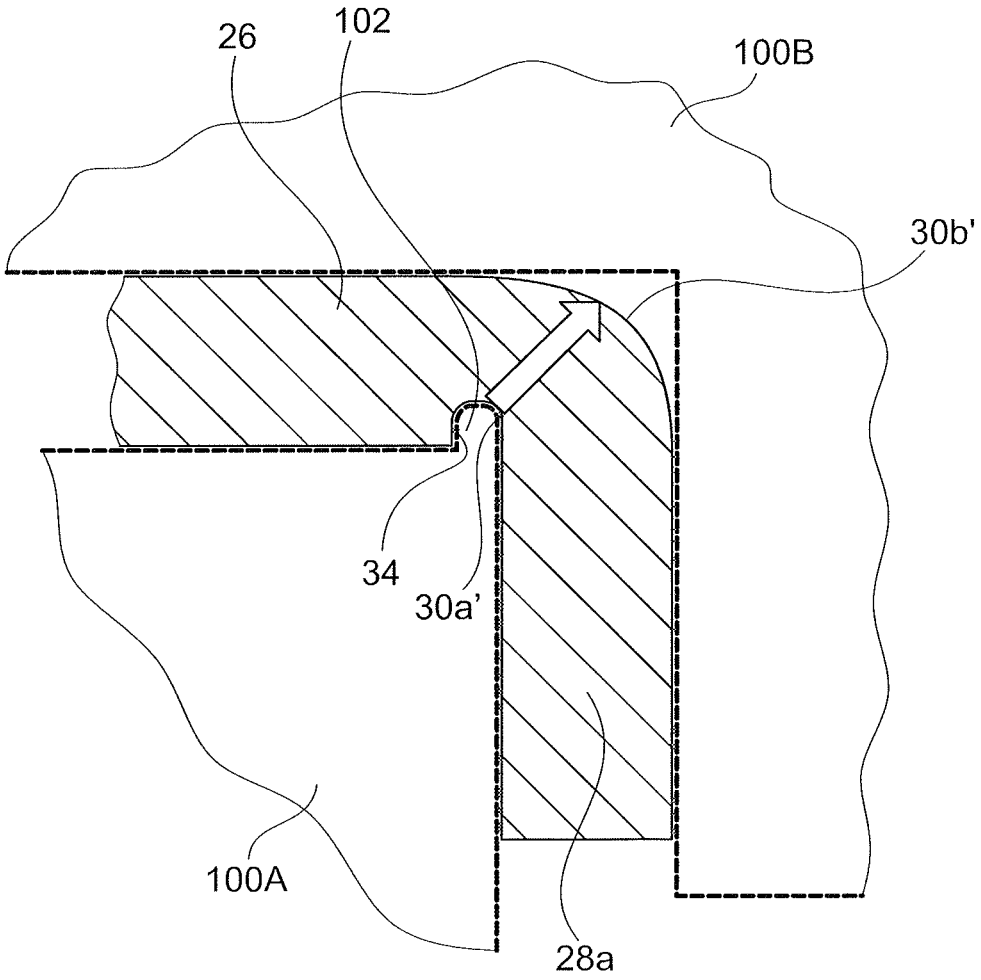
FIG. 5 is a schematic process diagram showing formation of the sensor tab of the target wheel.

FIG. 5 illustrates an exemplary formation process for forming the groove 34. As shown in FIG. 5, an arrow indicates material of the groove 34 of the target wheel 20 being forced to the modified outer corner 30*b*'. Two formation components or tools 100A, 100B are illustrated in FIG. 5. One of ordinary skill in the art would understand that these formation components 100A, 100B can include stamps, molds, holders, and any other known formation tools for stamped sheet metal bodies. As shown in FIG. 5, the formation component 100A includes a protrusion 102 for forming the groove 34 of the target wheel 20. One of ordinary skill in the art would recognize that alternative types of formation components, including profiles, shapes, and sizes differing from those illustrated in FIG. 5, could be used to form the groove 34 based on the present disclosure.

In one embodiment, a target wheel 20 for a camshaft phaser assembly 10 is provided. The target wheel 20 includes a sheet metal body including at least one sensor tab 22 formed along a radially outer edge 24 of the sheet metal body. The at least one sensor tab 22 includes a medial flange 26 positioned between first and second axially extending edges 28*a*, 28*b*. The at least one sensor tab 22 includes at least one inner corner 30*a* defined between the medial flange 26 and at least one of the first axially extending edge 28*a* or the second axially extending edge 28*b*, and at least one outer corner 30*b* defined between the medial flange 26 and at least one of the first axially extending edge 28*a* or the second axially extending edge 28*b*.

Figure 6:
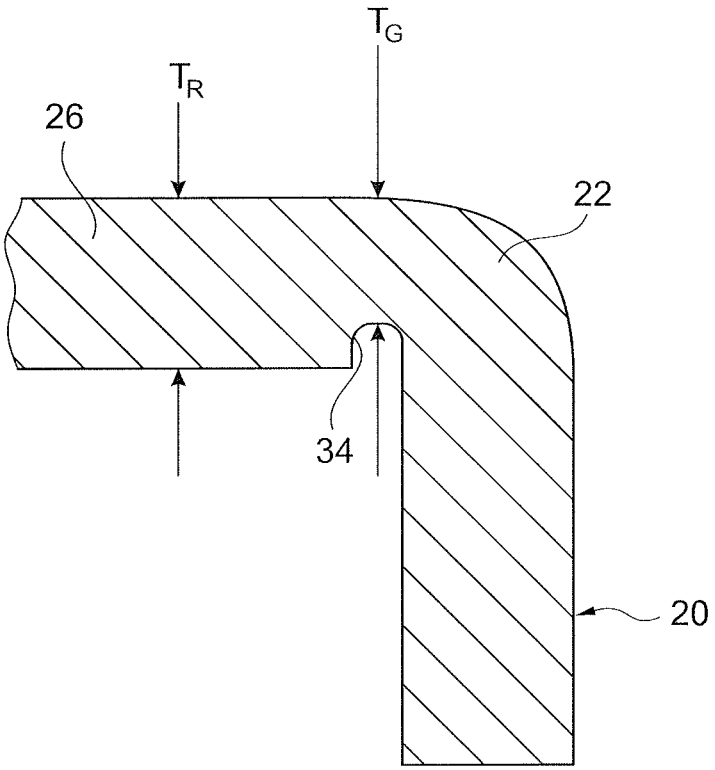
FIG. 6 is a magnified view of a groove formed in a sensor tab.

As shown in FIG. 6, a groove 34 is formed in the at least one inner corner providing a localized reduced thickness ($T_G$) of the sheet metal body at the groove 34 and at least one inner corner relative to areas of the sheet metal body away from the at least one inner corner, indicated by thickness ($T_R$) (i.e. a thickness of the target wheel 20 in a remainder of sensor tab 22 region away from the inner corner 30*a*). This reduced thickness ($T_G$) is caused by forming the groove 34 in the inner corner. As a result of the reduced thickness ($T_G$), an outer corner receives this displaced material formed by the groove 34 and the outer corner has a smaller radius compared to target wheels 20 lacking a groove 34.

Although the groove 34 is generally shown on an inner face of the medial flange 26, one of ordinary skill in the art would understand that the groove 34 can be formed on an inner face of the axial edges 28*a*, 28*b*.

The present disclosure generally discloses reducing a curvature of an edge of a sensor stab for a target wheel to reduce reading delays between the target wheel and an associated sensor. The present disclosure reduces reading delays by forcing material of the sensor tab from an inner corner/region of the tab to an outer corner/region of the sensor tab, thereby provided a thicker profile to the outer corner/region. Therefore, more material of the sensor tab is provided in a region of the associated sensor to provide a quicker and more reliable reading.

Having thus described the present invention in detail, it is to be appreciated and will be apparent to those skilled in the art that many physical changes, only a few of which are exemplified in the detailed description of the invention, could be made without altering the inventive concepts and principles embodied therein. It is also to be appreciated that numerous embodiments incorporating only part of the preferred embodiment are possible which do not alter, with respect to those parts, the inventive concepts and principles embodied therein. The present embodiment and optional configurations are therefore to be considered in all respects as exemplary and/or illustrative and not restrictive, the scope of the invention being indicated by the appended claims rather than by the foregoing description, and all alternate embodiments and changes to this embodiment which come within the meaning and range of equivalency of said claims are therefore to be embraced therein.

LOG OF REFERENCE NUMERALS camshaft phaser assembly 10
central valve 12
rotor 14
stator 16
sensor 18
target wheel 20
sensor tabs 22
radially outer edge 24
medial flange 26
first axially extending edge 28*a*
second axially extending edge 28*b*
inner corner 30*a*
outer corner 30*b*
groove 34

What is claimed is:

1. A method of forming a target wheel for a camshaft phaser assembly, the method comprising:

(i) providing a sheet metal body;

(ii) stamping the sheet metal body to form at least one sensor tab along a radially outer edge of the sheet metal body, the at least one sensor tab including a medial flange positioned between first and second axially extending edges, the at least one sensor tab including:

at least one inner corner defined between the medial flange and at least one of the first axially extending edge or the second axially extending edge, and at least one outer corner defined between the medial flange and at least one of the first axially extending edge or the second axially extending edge, and (iii) forming a groove in the at least one inner corner.

2. The method according to claim 1, wherein the at least one outer corner has a first radius prior to step (iii), and the at least one outer corner has a second radius that is less than the first radius after step (iii).

3. The method according to claim 2, wherein the second radius is 0.8 mm-1.2 mm.

4. The method according to claim 2, wherein the first radius is 1.6 mm-2.0 mm.

5. The method according to claim 2, wherein the second radius is 40%-70% of the first radius.

6. The method according to claim 1, wherein step (iii) is performed via stamping.

7. The method according to claim 1, wherein the at least one sensor tab includes two sensor tabs.

8. The method according to claim 1, further comprising:

positioning a sensor in an area adjacent to the at least one sensor tab, and determining a position of the target wheel based on a position of the at least one sensor tab relative to the sensor.

9. The method according to claim 1, wherein step (iii) is performed via a formation tool including a protrusion.

10. A target wheel for a camshaft phaser assembly, the target wheel comprising:

a sheet metal body including at least one sensor tab formed along a radially outer edge of the sheet metal body, the at least one sensor tab including a medial flange positioned between first and second axially extending edges, the at least one sensor tab including at least one inner corner defined between the medial flange and at least one of the first axially extending edge or the second axially extending edge, and at least one outer corner defined between the medial flange and at least one of the first axially extending edge or the second axially extending edge, and a groove formed in the at least one inner corner.

11. The target wheel according to claim 10, wherein the groove provides a localized reduced thickness of the sheet metal body at the at least one inner corner relative to areas of the sheet metal body away from the at least one inner corner.

12. The target wheel according to claim 10, wherein the at least one outer corner has a radius of 0.8 mm-1.2 mm.

13. The target wheel according to claim 10, wherein the at least one sensor tab includes two sensor tabs.

14. The target wheel according to claim 10, wherein the groove is formed via stamping.

* * * * *